US006358607B1

(12) United States Patent
Grotzner et al.

(10) Patent No.: US 6,358,607 B1
(45) Date of Patent: Mar. 19, 2002

(54) LABEL FOR CONCEALING INFORMATION

(75) Inventors: Roland Grotzner, Unterschleissheim; Helmut Schreiner, Karlsfeld, both of (DE)

(73) Assignee: Schreiner Etiketten und Selbstklebetechnick GmbH & Co., Oberschleisschiem (DE)

( * ) Notice: Subject to any disclaimer, the term of this patent is extended or adjusted under 35 U.S.C. 154(b) by 0 days.

(21) Appl. No.: 09/358,393

(22) Filed: Jul. 22, 1999

(30) Foreign Application Priority Data

Jul. 22, 1998 (DE) ..... 198 32 990
Dec. 5, 1998 (DE) ..... 298 21 703 U

(51) Int. Cl.[7] ..... G09F 3/10; G09F 3/02; B42D 15/02; A63F 3/06

(52) U.S. Cl. ..... 428/354; 428/916; 428/915; 428/42.1; 283/903; 283/901; 283/81

(58) Field of Search ..... 428/916, 915, 428/40.1, 42.1, 343, 354; 283/72, 81, 903, 901

(56) References Cited

U.S. PATENT DOCUMENTS 4,241,942 A 12/1980 Bachman
4,738,473 A 4/1988 Meloni et al.
5,294,470 A * 3/1994 Ewan ..... 428/916
5,582,434 A 12/1996 Skov et al.
5,601,887 A * 2/1997 Rich et al. ..... 428/916 X
5,895,075 A * 4/1999 Edwards ..... 428/916 X

FOREIGN PATENT DOCUMENTS

| | | |
|---|---|---|
| DE | 196 53 891 C1 | 6/1998 |
| DE | 197 05 380 C1 | 6/1998 |
| DE | 197 05 380 C1 | 10/1998 |
| DE | 197 16 099 A1 | 10/1998 |
| EP | 0 341 699 A1 | 11/1989 |
| GB | 2 243 578 A | 11/1991 |
| GB | 2 280 402 A | 2/1995 |
| WO | WO 96/40395 | 12/1996 |

OTHER PUBLICATIONS

Auergesellschaft Aktiengesellschaft, *Siegelmarke für Atemshutzgerate,* Jul. 27, 1957.

* cited by examiner

*Primary Examiner*—Daniel Zirker
(74) *Attorney, Agent, or Firm*—Nixon Peabody LLP; Donald R. Studebaker

(57) ABSTRACT

A label for concealing proprietary information is attached to a backing material and includes a layer of adhesive, a base layer, an opaque scratch layer, which can be removed by rubbing, and an authentication mark applied to the scratch layer. The information may be on the backing material or between the base and scratch layers. In another embodiment, an ink film is located between the base layer and an object. Areas of anti-stick lacquer are provided between the ink film and the object, so that the relative adhesive force on the ink film has spatial variations.

40 Claims, 3 Drawing Sheets

LABEL FOR CONCEALING INFORMATION

BACKGROUND OF THE INVENTION

1. Technical Field of the Invention

The present invention relates to a label for concealing information, e.g., a security number for check cards and the like, and more particularly, to a label wherein information can be made visible by removing a layer of the label.

2. Description of the Related Art

There are numerous instances where it is desirable to guard against information being accessed by unauthorized persons. When sending security numbers for check or credit cards for example, the account holder is provided with a Personal Identification Number (PIN) which is imprinted on a piece of paper, this number being used by the account holder, e.g., for obtaining money from cash dispensers or for dealing with his account. In general, such PINs are employed for protecting personal data from unauthorized access. The provision of such PINs is therefore handled in an extremely discreet manner which is why the PINs, which are usually printed on a slip of paper, are concealed.

To this end, it has been possible for some time to cover up the information, a security number for example, with an opaque ink film. This ink film can be removed again by rubbing it off so that the previously concealed information is revealed once more. This ink film is frequently applied to a label which is then stuck over the information. One example of such a label is disclosed in DE 197 05 380. Here, the ink film is located on a preferably transparent base layer which may consist of a film of synthetic material for example. One then sticks this label over the information needing to be concealed. As an alternative, it is possible for the information that needs to be concealed to be provided on that surface of the base layer to which the ink film will be applied. If the base layer is located between the information and an opaque ink film which is to be removed by a rubbing action, then the information will not be damaged by the removal of the ink film. Since the ink film is removed irreversibly by the rubbing action, it will be apparent from its condition as to whether or not an unauthorized person has touched it.

In terms of security, however, this solution gives rise to certain misgivings. There is a danger that an unauthorized person might remove the ink film by rubbing it away, learn about the information located there below and then conceal this information again by applying fresh ink. Thus, the mere presence of an ink film provides no guarantee as to the originality of this ink film.

SUMMARY OF THE INVENTION

It is an object of the present invention to provide a label of the type mentioned herein above in which the authenticity, i.e., the original state of the ink film that is irreversibly removable by rubbing, is immediately recognizable by simple inspection.

A further object of the present invention is to provide an authentication mark which is attached or applied to the scratch layer. By removing the scratch layer, this authentication mark will be damaged or destroyed so that one can see at once whether the scratch layer has been interfered with on a previous occasion.

In accordance with a further object of the present invention, the authentication mark can be a written word or character set, a picture element, a hologram or a pattern, and can be a single color or multicolored.

In accordance with yet a further object of the present inanition, the adhesive layer is attached to a plurality of locations which do not overlap the information that is to be concealed.

Still another object of the present invention is to provide an adhesive layer which is transparent, thereby making the information located thereunder visible in the case where the adhesive layer is applied over an extensive area of the surface of a transparent base layer.

Prior art scratch layers crumble into crumb-like bits when the layer is rubbed for the purposes of removing it. Insofar as cleanliness is concerned, this is hardly a satisfactory solution. If, however, the scratch layer is provided with some contact adhesive, then the crumbs resulting from the rubbing action will stick together thanks to this contact adhesive thereby ensuring that the detachment of the scratch layer will occur in a clean and tidy manner. For this reason, in accordance with another object of the present invention, the scratch layer incorporates a contact adhesive.

In accordance with another object of the invention, provision is made for the layer of adhesive to correspond to the shape of the sealed region. Prior to use, this layer of adhesive may be protected by means of a protective, adhesive-repelling or adhesive-rejecting film. The adhesive layer may also be arranged on the object to which the label is to be attached.

According to the present invention, there is provided a label for concealing information including a base layer, information to be concealed provided on the base layer, an adhesive layer, and a scratch layer. The scratch layer is irreversibly removable from the base layer by rubbing. An authentication mark is attached to the scratch layer.

BRIEF DESCRIPTION OF THE DRAWINGS

Preferred embodiments of the present invention will now be described, by way of example only, with reference to the accompanying drawings, of which.

DESCRIPTION OF THE PREFERRED EMBODIMENTS

Figure 1:
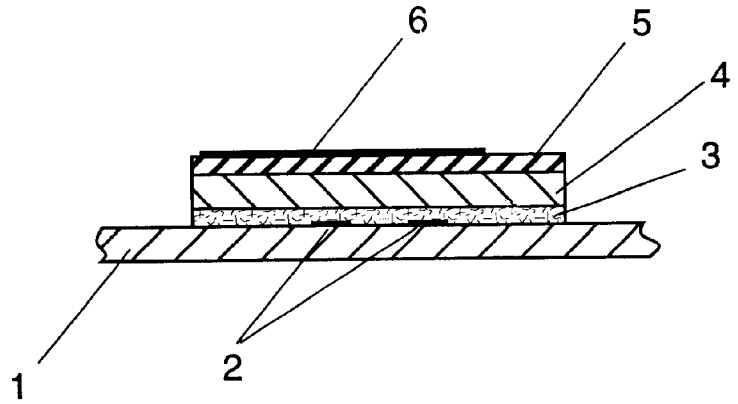
FIG. 1 is a cross-section of a first embodiment of the label of the present invention.

Referring to FIG. 1, information 2 that is to be concealed or covered over is located on a backing medium 1 to which the label is fixed by means of a transparent adhesive layer 3. The baking medium 1 may be made of paper, cardboard, or any other form of backing material. A transparent base layer 4, to which a scratch layer 5 is attached is located above the adhesive layer 3. Scratch layer 5 can extend over the entire base layer or over a substantial part of the base layer, this variant permits the label to be produced in a particularly simple manner. Moreover, the scratch layer 5 may, for example, be an opaque ink film of a flexographic printing ink or some other form of ink.

An authentication mark 6 is applied to the scratch layer 5. Depending on the design of the authentication mark, it is of particular advantage if the authentication mark is overprinted, embossed, or impressed using a hot embossed foil. The hot embossed foil may, for example, incorporate a hologram as the authentication mark. The application thereof may be effected depending on the type and the desired size of the authentication mark 6, for example, by overprinting. Moreover, the authentication mark may be engraved in the scratch layer in the manner of a relief. An authentication mark 6 produced in this manner can only be reconstructed with extreme difficulty once the scratch layer 5 has been damaged.

In order to forestall even the most skillful form of manipulation, the authentication mark located on the scratch layer may be continued onto the base layer located thereunder. The part of the authentication mark located on the base layer cannot be removed by rubbing. Even if the scratch layer is reapplied after being removed, it is easy to detect from the fragment of the authentication mark remaining on the base layer that this is not the original scratch layer. It is virtually impossible to recreate the part of the authentication mark which was removed in its truly original manner.

Since some printing inks tend to become bleached in the presence of solvents that may possible be incorporated in the adhesive and as this would then be fatal with regard to the information which is intended to be concealed by the label, the adhesive layer need not be attached to an extensive area of the surface but may be attached at isolated points to the base layer, whereby the particular region occupied by the information would be left untouched. In addition, this would allow any desired adhesive to be used.

Figure 2:
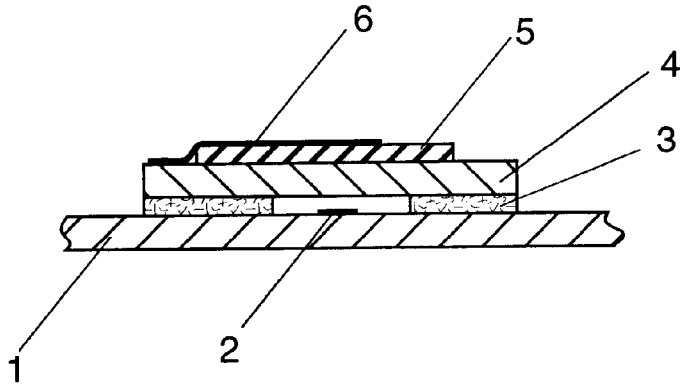
FIG. 2 is a cross-sectional view of a second embodiment of the label of the present invention.

As shown in FIG. 2, adhesive layer 3 is not applied so as to cover an extensive area of the surface of the base layer 4, but rather it is applied at scattered locations. Also, adhesive layer 3 does not cover up the information 2 so it need not be transparent in order to make the information visible through the transparent base layer 4 following the removal of the scratch layer 5. The scratch layer 5 extends over a partial region of the base layer 4 needed to conceal the information 2. On the one hand, this permits the authentication mark 6 to be continued on the base layer 4.

It is often advantageous to attach other things, such as serial numbers, small pictures and the like, to the base layer in addition to the scratch layer.

The scratch layer 5 is extended exclusively over that part of the base layer on which the information is provided.

When sending credit or check cards or other objects which are dispatched together with a proprietary item of information, e.g., a security number, that is concealed by a label in accordance with the invention, it is especially advantageous for the above-mentioned object to be secured to the label. For this reason the label is coated at at least one position with an adhesive which is used for securing such an object.

Figure 3:
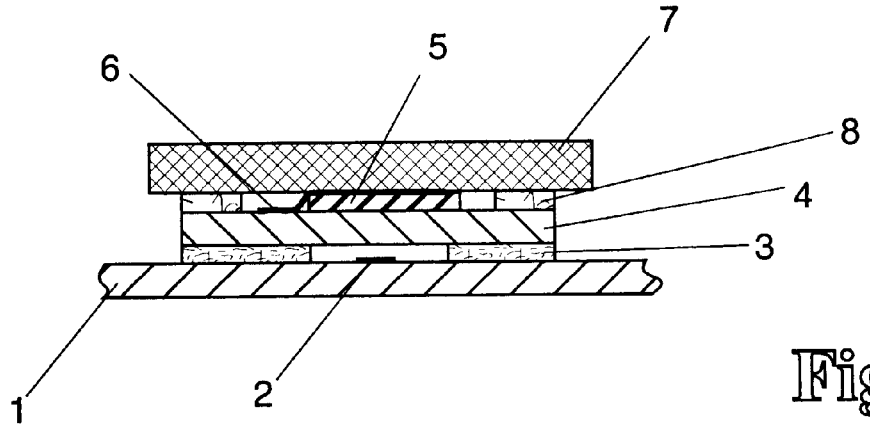
FIG. 3 is a cross-sectional view of a third embodiment of the label of the present invention.

As is depicted in FIG. 3, space is created on the part of the base layer 4 not covered by the scratch layer 5 for the application thereto of written words or characters, patterns, serial numbers, impressions, stampings (not shown) or an adhesive 8 for securing it to an object 7. A label of this type is particularly suitable in connection with the dispatch of credit or check cards having security numbers, since the sender has the ability to simultaneously secure the label hiding the security number to the particular card.

Although now shown, base layer 4 could include at least one stamping which may be in the form of a security stamp. Due to a stamping of this nature, an unauthorized third party could be prevented from detaching the label from the background and thereafter replacing it on the background so as to thereby acquire knowledge of the proprietary information. Namely, any attempt, without fail, will be made apparent in an irreversible manner, if the base layer is divided into a plurality of separate segments by the stamping process, such segments being unable to be replaced on the background in the appropriate manner after the label has been detached.

Figure 4:
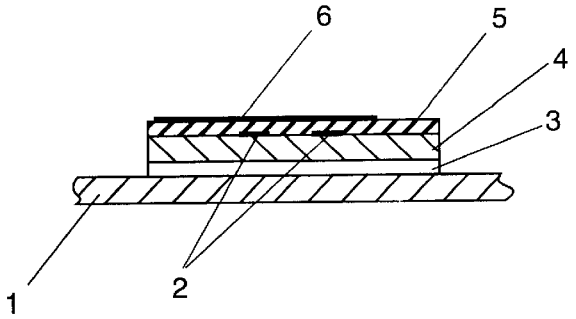
FIG. 4 is a cross-sectional view of a fourth embodiment of the label of the present invention.

FIG. 4 shows another embodiment of the label in accordance with the present invention wherein the concealment of the information 2 is not achieved by sticking the label over it, but rather the information 2 is a part of the label and is located between the scratch layer 5 and the base layer 4. This variant has the advantage that the base layer 4 and the adhesive layer 3 do not need to be transparent.

Figure 5A:
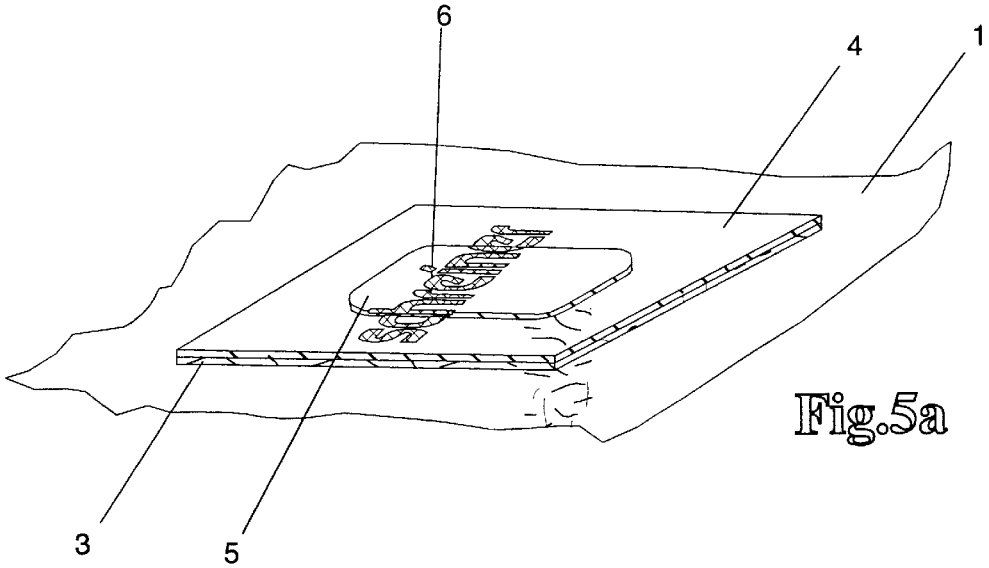
FIG. 5*a* is a perspective view of the label in accordance with the present invention showing the undamaged authentication mark prior to the detachment of the scratch layer.

FIG. 5*a* illustrates a label which is adhered to a backing 1 and where scratch layer 5 is still undamaged. Here, the authentication mark 6 is illustrated in the form of a written word or character set and extends partially over the base layer 4 and partially over the scratch layer 5. In order to ensure that the authentication mark 6 will fulfill its purpose, namely, that it will be damaged at least in part should someone try to access the information 2 concealed by the scratch layer 5, it should be attached such that it is located, at least partially, directly over the proprietary information 2.

Figure 5B:
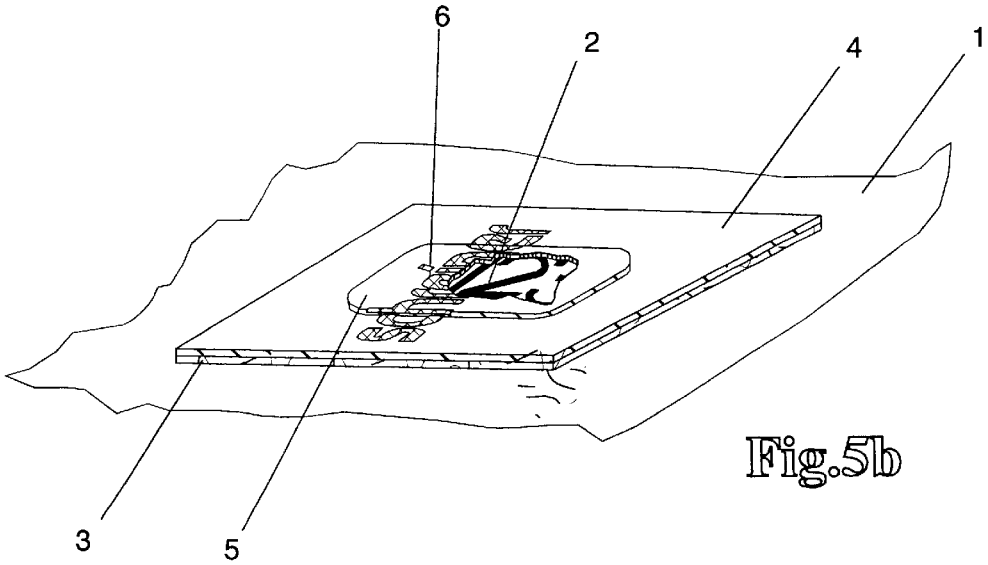
FIG. 5*b* is a perspective view of the label in accordance with the present invention showing the damaged authentication mark following the detachment of the scratch layer.

FIG. 5*b* shows the same label after the scratch layer 5 has been partially damaged. At the same time as the scratch layer 5 is being destroyed, so too will the authentication mark 6 be destroyed at the position where the scratch layer 5 was removed by the rubbing action. Subsequent reproduction could only be effected, if at all, by using a great deal of effort, thereby ensuring, by virtue of the introduction of the authentication mark 6, that it is immediately apparent as to whether the scratch layer 5 has or has not been manipulated.

Should, against all expectations, an attempt be made to access the information located underneath the label by detaching the base layer so as to thereby avoid damaging the scratch layer, a provision is made for the base layer to include at least one sealed region on the side thereof remote from the scratch layer. This region incorporates a coating which indicates in an irreversible manner that the base layer has been separated from an object after the label has been secured to the object.

The coating comprises at least one ink film which, when the base layer is secured to the object, adheres to the object with a first adhesive force and to the base layer with a second adhesive force. Furthermore, adhesive-force-adjusting-means are provided which allow the ratio between the first and second adhesive forces to be set at locally different values. If the base layer is separated from the object, the ink film remains partially stuck to the base layer and partially stuck to the object. An irreversible optical alteration of the label is produced in this manner. Even if it is stuck back on the object following the detachment of the base layer, the ink film will have different reflecting properties since air will then be trapped between the ink film and the object, or between the ink film and the base layer, thereby irreversibly altering the optical impression produced by the ink film and thus being clearly detectable.

The adhesive-force-adjusting-means embrace a treatment of the object and/or of the base layer, wherein the treatment is effected at scattered locations. Before being printed-on, the foils have to be subjected to a print-pretreatment in order to ensure that the printing ink is tightly bound to the foil so as to produce a lasting printed image. If certain regions of the foil for the label are shielded from the print-pretreatment, for example, by being covered up, then the ink film applied there will not adhere very well. However, following separation the ink film will continue to adhere to that one of the two parts which was subjected to the print-pretreatment. In this way, the ink film separation effect that is being sought for when detaching the base layer can be achieved with the simplest of means.

As an alternative or in addition thereto, it may be advantageous to use an anti-stick lacquer, which will be described further herein, that is applied at scattered locations, as the adhesive-force-adjusting-means. The anti-stick lacquer can, in particular, easily be overprinted in the form of a pattern or in the form of a written word or character set, so that a particular image, such as the word "OPENED" for example, will be visible when the two parts are separated.

The adhesive-force-adjusting-means may also embrace a bonding agent (primer) applied at scattered locations. Such a bonding agent, which is effective to produce very tight bonding between the printing ink and the background, may easily be applied by means of a printing process.

The decisive factor in regard to each of the adhesive-force-adjusting-means is that it should affect the ratio between the forces with which, on the one hand, the ink film adheres to the base layer and with which it adheres to the covering layer on the other. The adhesion at the scattered locations will thus be greater on the one part than on the other part, so that when the two parts are separated, the ink film will divide in a special pattern, i.e. on part of the ink film on the base layer and the remainder of the ink film on the covering layer. The adhesive coating ensures that the ink film will adhere to the region coated with adhesive with a precisely adjustable force. The coating may be attached selectively either to the object or to the base layer.

It is also advantageous to use a transparent foil as the base layer, this preferably being printed-on or tinted using a non-opaque pale color or ink. This will thereby result in a particularly obvious contrast between the different regions of the ink film should the two parts be stuck back together again following a first separation thereof. A particularly easily detectable contrast effect also arises if the ink film comprises a dark and/or opaque color or ink.

In dependence on the field of use, either the base layer itself may be provided with the information that is to be concealed by the scratch layer, in which case it may be opaque or transparent, or the base layer may be partially transparent and the information is then located on the backing medium (paper or the like) to which the label in accordance with the invention is stuck. Consequently, the base layer is at least partially transparent or opaque so as to make the information located below the base layer visible after the scratch layer has been removed.

Figure 6:
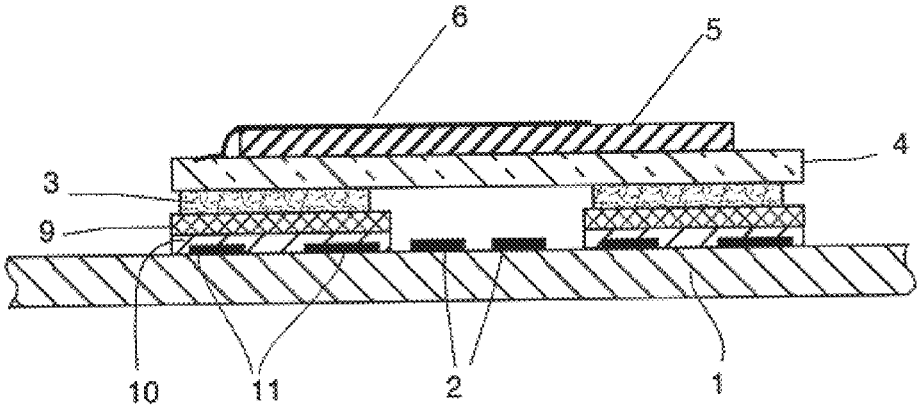
FIG. 6 is a cross-sectional view of a fifth embodiment of the label of the present invention.

Referring to FIG. 6, backing medium 1, for example, a sheet of notepaper, is imprinted with an anti-stick lacquer 11 at scattered locations. The anti-stick lacquer 11 may take the form of a word such as "VOID" or "OPENED". A layer of bonding agent 10 is printed over the anti-stick lacquer 11. The layer of bonding agent 10 is effective to firmly stick an overprinted ink film 9 to the backing 1, at least at those positions where it has not been imprinted with anti-stick lacquer 11. Ink film 9 is then covered with a layer of contact adhesive 3. Contact adhesives are particularly suitable for use as the adhesive since they do not require any additional activation process other than that of removing a protective paper backing. However, the use of an adhesive that is activatable by water is also advantageous.

The anti-stick lacquer 11, the bonding agent 10, the ink film 9 and the adhesive layer 3 are arranged around a region in which the information 2 that is to be concealed is located on backing 1, so as to thereby form a sealed area which, substantially or completely encompasses the information. The layer of adhesive can correspond to the shape of the sealed area. Prior to use, this layer of adhesive may be protected by means of a protective, adhesive-repelling or adhesive-rejecting film. The adhesive layer may also be arranged on the object to which the label is to be attached.

The base layer 4, together with the scratch layer 5 and an object 7 arranged there above may, for example, be adhered at the points of adhesion formed by the contact adhesive layer 3 (see FIG. 3).

The ink film 9 adheres to the base layer 4 via the adhesive layer 3 with a first adhesive force, while the surface of the ink film 9 remote from the base layer 4 adheres to the backing 1 with a second adhesive force. The ratio of these two adhesive forces is varied locally by means of the "adhesive-force-adjusting-means" consisting of the anti-stick lacquer 11 and the bonding agent 10. The first adhesive force is stronger than the second adhesive force at those regions incorporating the anti-stick lacquer 11, while the first adhesive force is weaker than the second adhesive force at those regions not provided with the anti-stick lacquer 11. Since, due to the effect of the bonding agent 10, the ink film 9 adheres firmly to backing medium 1 except at those points at which it was prepared with anti-stick lacquer 11 prior to the application of the bonding agent 10, the ink film 9 will thus separate into two parts if any attempt is made to remove the base layer 4.

If after removal base layer 4 was to be stuck back on the backing 1 that part of the ink film 9 remaining on the base layer 4 could of course be inserted back into the ensuing gaps in the ink film. However, as air has now entered in between the ink film 9 and the backing 1, due to the action of tearing parts of the ink film 9, the light reflecting behavior of these parts will be altered in comparison with the parts of the ink film 9 remaining on the backing 1. This can be observed through the transparent base layer 4, so that the opening incident will be made clearly apparent. In this way, it is detectable when someone has tried to gain knowledge of the information 2 in an unfair manner. If, for example, this information relates to a security number, then it should be immediately blocked.

Figure 7:
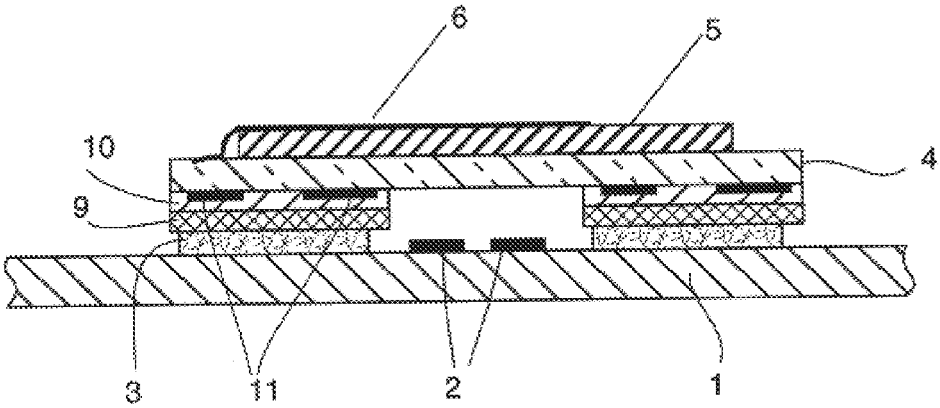
FIG. 7 is a cross-sectional view of a sixth embodiment of the label of the present invention.

Another embodiment of a label incorporating an authentication mark is shown in FIG. 7 and includes a base layer 4 consisting of a transparent foil located below the scratch layer 5. The lower surface of the base layer 4 is imprinted with an anti-stick lacquer 11 at scattered locations. The anti-stick lacquer 11 may take the form of a word such as "VOID" or "OPENED" for example. A layer of bonding agent 10 is printed over the anti-stick lacquer 11. The layer of bonding agent 10 is effective to firmly stick an overprinted ink film 9 to the base layer 4, at least at those positions where the base layer 4 has not been imprinted with the previously mentioned anti-stick lacquer 11. The ink film 9 is then covered with a layer of contact adhesive 3. The anti-stick lacquer 11, the bonding agent 10, the ink film 9, and the layer of contact adhesive 3 are arranged around the edge of the base layer 4 and thereby form a sealed area which, substantially or completely encompasses the central region.

The label described thus far is usually kept in a state of readiness on a siliconised support film (not illustrated). Prior to use, it is separated (manually or by machine) from the siliconised support film and stuck to backing medium 1, for example, a sheet of notepaper, by means of the exposed adhesive layer 3.

After the label has been placed on the backing medium 1, the ink film 9 adheres to the backing 1 via the adhesive layer 3 with a first adhesive force, while the surface of the ink film 9 facing the base layer 4 adheres thereto with a second adhesive force. As with the embodiment of FIG. 6, the ratio of these two adhesive forces is varied locally by means of the "adhesive-force-adjusting-means" consisting of the anti-stick lacquer 11 and the bonding agent 10, so that the first adhesive force is strong than the second adhesive force at those regions incorporating the anti-stick lacquer 11, while the first adhesive force is weaker than the second adhesive force at those regions not provided with the anti-stick lacquer 11. Since, due to the effect of the bonding agent 10, the ink film 9 adheres firmly to the base layer 4 except at those points at which it was attached to anti-stick lacquer 11 prior to the application of the bonding agent 10. The ink film 9 will thus separate into two parts in the face of any attempt to remove the base layer 4.

Figure 8:
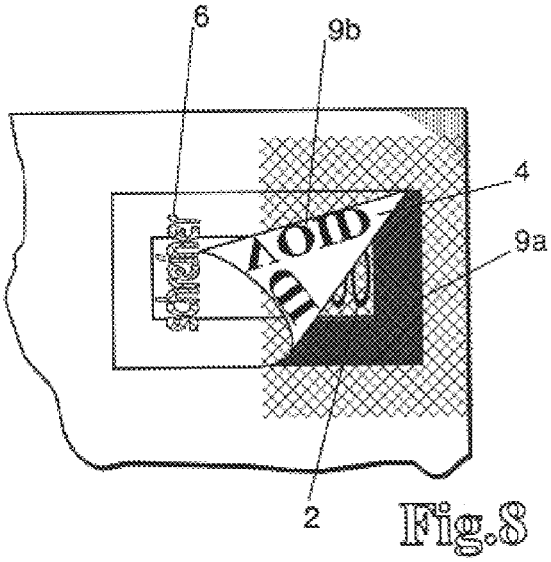
FIG. 8 is a perspective view of the label of FIG. 6 having a partially withdrawn base layer.

FIG. 8 illustrates the situation where someone has tried to access the security number 2 by detaching the base layer 4 in order to avoid damaging the authentication mark 6. Since the ink film 9 adheres to the base layer 4 and to the object 1 with locally different adhesive forces, due to the use of the adhesive-force-adjusting-means described above, the ink film 9 will be separated into two parts 9*a* and 9*b* when the base layer 4 is detached, the first of these remaining on the object 1, while the second will remain on the base layer 4. In the example, the second part 9*b* takes the form of the word "VOID" while the part 9*a* has a form complementary thereto. As a result of the changed light reflecting properties of the ink film 9, the character set "VOID" remains perceptible through the transparent base layer 4 even after the base layer 4 has been stuck back in place.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed:

1. A label for covering information comprising:

a base layer having opposed first and second surfaces;

an adhesive layer attached to the first surface;

an opaque scratch layer attached to the second surface, and an authentication mark attached to the scratch layer, wherein the scratch layer is irreversibly removable from the base layer and said base layer includes at least one sealed region on the surface remote from said scratch layer, said seal region incorporating a coating which, after the label has been secured to a medium, indicates in an irreversible manner that said base layer has been removed from the medium.

2. The label according to claim 1, wherein said scratch layer extends over the entire surface of the base layer.

3. The label according to claim 1, wherein said scratch layer extends only over a portion of said base layer on which said information is provided.

4. The label according to claim 3, wherein said authentication mark extends over a part of said base layer and a part of said scratch layer.

5. The label according to claim 1, further comprising an object adhered to said base layer.

6. The label according to claim 1, wherein said authentication mark is overprinted on said scratch layer.

7. The label according to claim 1, wherein said authentication mark is embossed on said scratch layer with a hot embossed foil.

8. The label according to claim 7, wherein said authentication mark is a hologram.

9. The label according to claim 1, wherein said authentication mark is adhered to said scratch layer.

10. The label according to claim 1, wherein said authentication mark is engraved in said scratch layer.

11. The label according to claim 1, wherein said authentication mark is a written character set.

12. The label according to claim 1, wherein said authentication mark is a picture element.

13. The label according to claim 1, wherein said authentication mark includes a pattern.

14. The label according to claim 1, wherein said authentication mark is of a single color.

15. The label according to claim 1, wherein said authentication mark is multi-colored.

16. The label according to claim 1, wherein said base layer includes at least one stamping.

17. The label according to claim 16, wherein said base layer is subdivided into a plurality of separate segments by said stamping.

18. The label according to claim 1, wherein said adhesive layer is attached to said base layer at a plurality of discrete locations, such that said adhesive layer does not cover said information.

19. The label according to claim 1, wherein said adhesive layer is transparent.

20. The label according to claim 19, wherein said adhesive layer is attached to an extensive area of the first surface of said base layer, and said information is covered by said adhesive layer.

21. The label according to claim 1, wherein said scratch layer includes a contact adhesive.

22. The label according to claim 1, wherein a layer of adhesive corresponding to the shape of said sealed region is arranged on said base layer.

23. The label according to claim 22, wherein said adhesive is a contact adhesive.

24. The label according to claim 22, wherein said adhesive is a water activatable adhesive.

25. The label according to claim 1, further comprising at least one ink film attached to said base layer, wherein when said label is secured to the medium, said film adheres to the medium with a first adhesive force and adheres to said base layer with a second adhesive force; and an adhesive force adjusting means for allowing the ration between said first adhesive force and said second adhesive force to be varied.

26. The label according to claim 25, wherein said ink film is printed on said base layer.

27. The label according to claim 25, wherein said adhesive force adjusting means is applied at scattered locations on said base layer.

28. The label according to claim 25, wherein said adhesive force adjusting means is an anti-stick lacquer applied at scattered locations on said base layer.

29. The label according to claim 25, wherein said adhesive force adjusting means is a bonding agent applied at scattered locations on said base layer.

30. The label according to claim 25, wherein said adhesive force adjusting means are a printing on said base layer.

31. The label according to claim 25, wherein said adhesive force adjusting means includes a written character set.

32. The label according to claim 25, wherein said at least one ink film comprises a dark and opaque color.

33. The label according to claim 32, wherein the color of said at least one ink film contrasts with a color of said base layer.

34. The label according to claim 1, further comprising a coating arranged on said base layer in a form corresponding to the at least one sealed region.

35. The label according to claim 1, wherein said base layer is printed with a non-opaque color.

36. The label according to claim 1, wherein said adhesive is a colored adhesive.

37. The label according to claim 1, wherein said base layer is transparent.

38. The label according to claim 1, wherein said base layer is opaque.

39. The label according to claim 1, wherein the information comprises security numbers.

40. The label according to claim 1, wherein said base layer is tinted with a non-opaque color.

* * * * *